United States Patent [19]

Uredat-Neuhoff

[11] Patent Number: 4,714,028

[45] Date of Patent: Dec. 22, 1987

[54] HEIGHT ADJUSTABLE TABLE

[75] Inventor: Angela Uredat-Neuhoff, Lindern/Oldenburg, Fed. Rep. of Germany

[73] Assignee: Inaba Seisakusho Ltd., Tokyo, Japan

[21] Appl. No.: 843,336

[22] Filed: Mar. 24, 1986

[30] Foreign Application Priority Data

Apr. 3, 1985 [DE] Fed. Rep. of Germany ..... 3512201
Apr. 3, 1985 [DE] Fed. Rep. of Germany ... 8510001[U]

[51] Int. Cl.[4] ..... A47B 11/00

[52] U.S. Cl. ..... 108/144; 108/138; 248/420

[58] Field of Search ..... 108/144, 138, 137, 147; 248/420

[56] References Cited

U.S. PATENT DOCUMENTS

| | | | |
|---|---|---|---|
| 358,505 | 3/1887 | Tatum | 108/138 |
| 575,684 | 1/1897 | Baxter | 108/147 X |
| 688,659 | 12/1901 | Manson | 108/138 |
| 3,195,482 | 7/1965 | Whitfield | 108/138 |
| 3,841,696 | 10/1974 | Wagner | 248/420 X |
| 4,194,452 | 3/1980 | Crowther et al. | 108/138 |
| 4,566,741 | 1/1986 | Eriksson et al. | 108/138 X |

FOREIGN PATENT DOCUMENTS

| | | | |
|---|---|---|---|
| 611018 | 12/1960 | Canada | 248/420 |
| 16353 | 5/1898 | Switzerland | 108/138 |

*Primary Examiner*—Peter A. Aschenbrenner
*Attorney, Agent, or Firm*—Frank J. Jordan; C. Bruce Hamburg; Manabu Kanesaka

[57] ABSTRACT

A table more specially in the form of desk has a desk frame (10) that has an oblique element (16) extending in an upward direction, in which there is an arrangement (44 and 59) for adjustment of the height of the top part (21) of the desk. This element (16) accommodates a sliding element (44) which at its top end bears a support member (17 and 18) for the top part (21) of the desk. The latter may be shifted in relation to the support member (17 and 18) and is connected with the desk frame (10) by an adjustment arrangement (23) so that when the top part (21) of the desk is adjusted in height the top part is kept from moving horizontally to any substantial extent in relation to the person using the desk.

8 Claims, 12 Drawing Figures

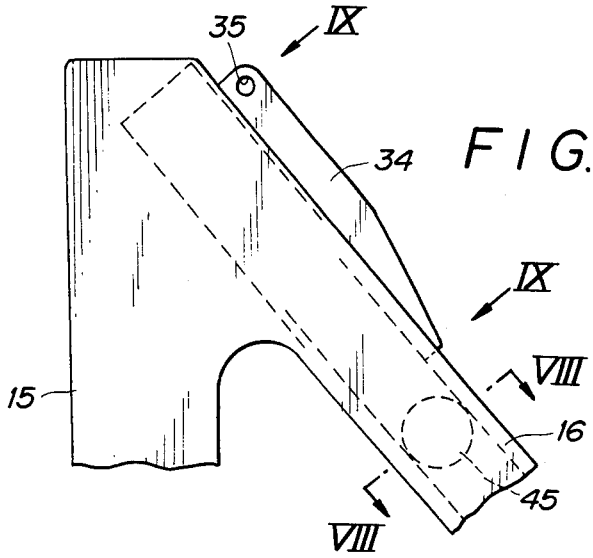
FIG. 7
FIG. 8
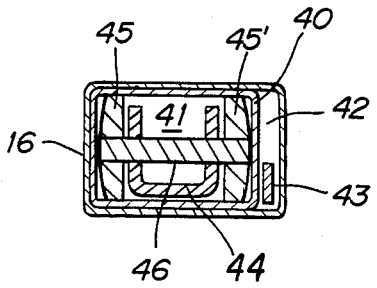
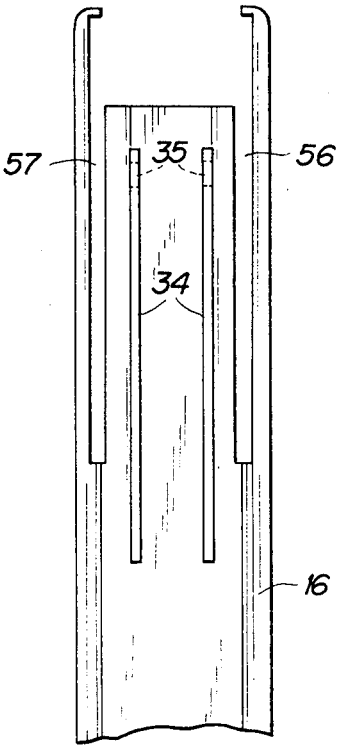
FIG. 9

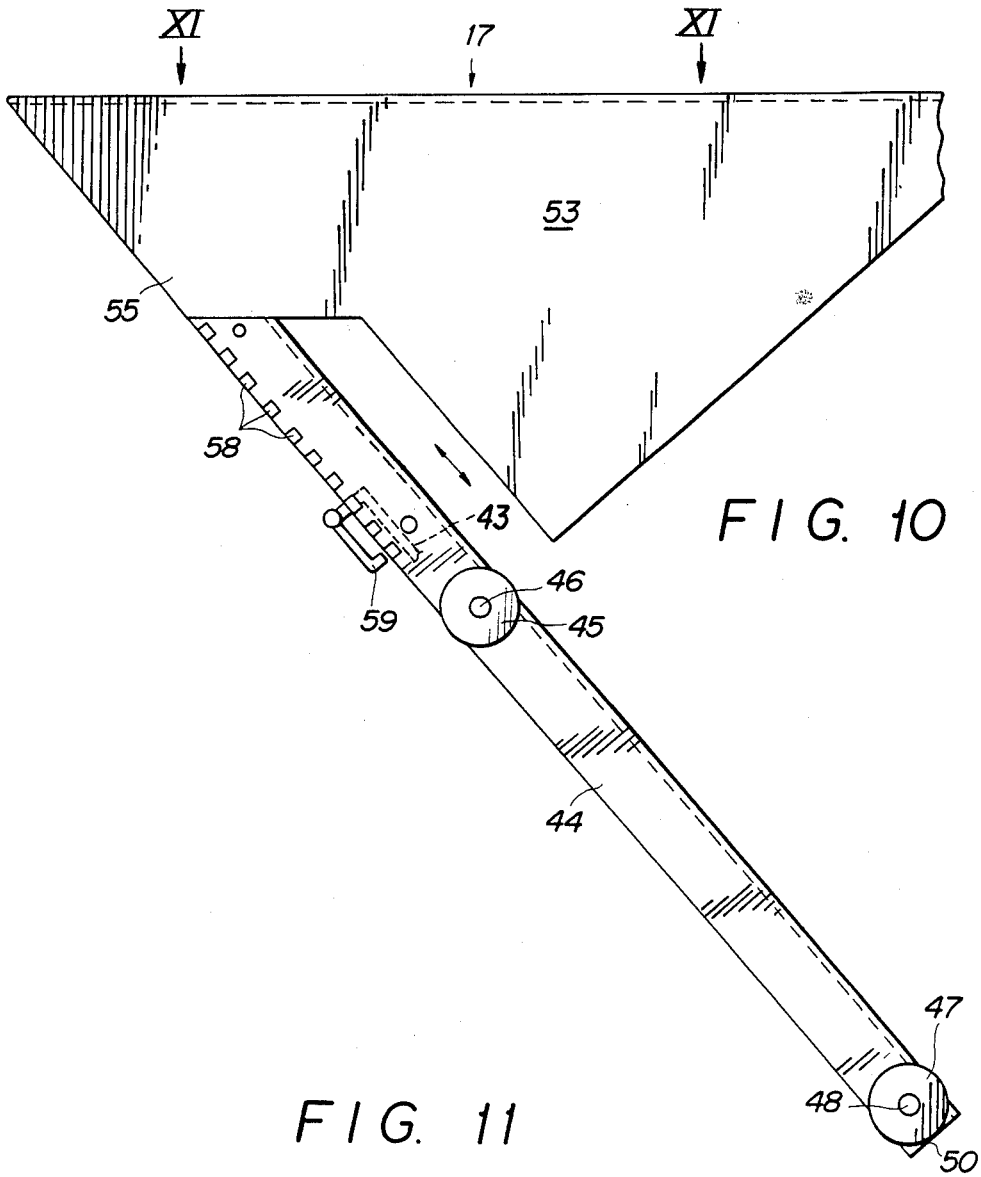
FIG. 10
FIG. 11
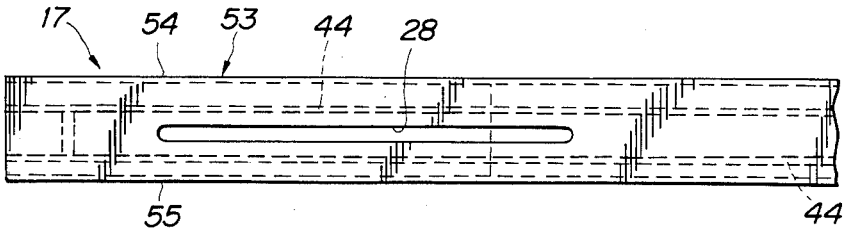

HEIGHT ADJUSTABLE TABLE

The invention relates to a desk.

The German utility model No. 8,320,536 discloses an adjustable table. Its side frames are respectively made up of two triangular elements in the form of right-angled isoceles triangles joined along their hypotenuses. By relative displacement of the hypotenuses it is possible to adjust the height of the table top. For this purpose it is however necessary to slacken off screws and tighten them again, this being relatively inconvenient.

The German utility model No. 8,216,473 also discloses a table whose top may be adjusted in height. To make this possible the table frame has oblique supports on which the top may be fixed at different heights, wherein movement of the top can be made after undoing screws and then tightening them up.

Furthermore the German unexamined specification No. 3,111,473 discloses a table with a vertically adjustable top supported by springs so that it may be attached to the side frames at different heights, wherein the table requires a mechanism for different movements of the desk top in a horizontal and vertical direction. More especially, when the desk top has things on it this is difficult and only possible on following complicated instructions that are not always clear.

Therefore one aim of the present invention is to contrive a desk or indeed any similar piece of furniture, which is simple to adjust in height.

In accordance with this invention this object is achieved, wherein the desk is compact with a pleasing appearance and is simple to use.

In the desk of the invention, the position of the projection of the top part of the desk on the floor is not substantially shifted, when the top part of the desk is shifted to a different height. From the point of view of the person using the desk this will mean that the desk top is not moved away from him or her when it is set to a higher level, this being different to the case, for example, of the tables described in the two German utility models noted above.

Further details and advantageous further outgrowths of the invention will be seen from the following description of an embodiment of the invention, as shown in the figures, and which is only presented by way of example and not of limitation, and from the dependent claims.

FIG. 7 shows a detail of the desk frame from the side.

FIG. 8 is a section taken on the line VIII—VIII of FIG. 7.

FIG. 9 is an elevation view on the line IX—IX of FIG. 7.

FIG. 10 is a side view for showing a part used for adjustment of height.

FIG. 11 is an elevation view of the part as shown in FIG. 10, looking along the arrows XI—XI of said figure.

Figure 1:
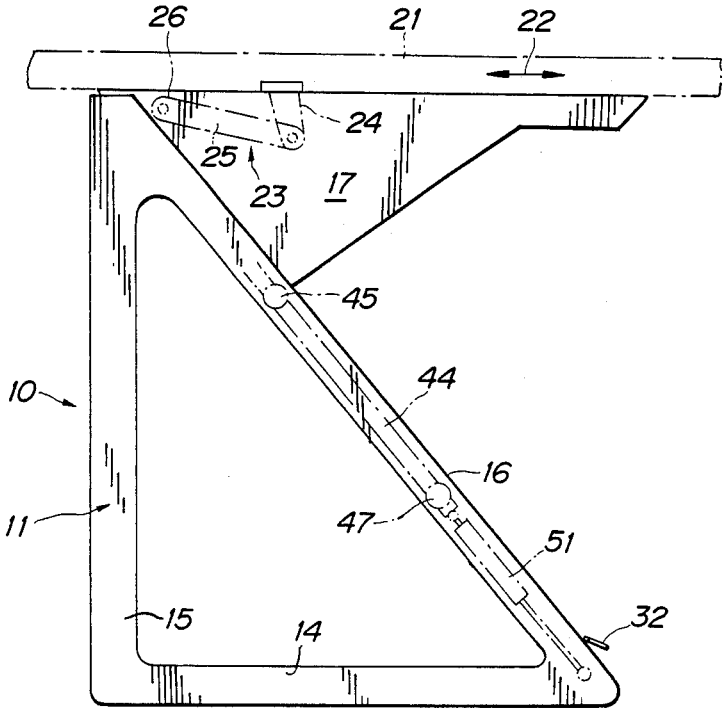
FIG. 1 is a side view of a preferred embodiment of a desk in accordance with the invention, the top part of the desk being at a low level.
Figure 5:
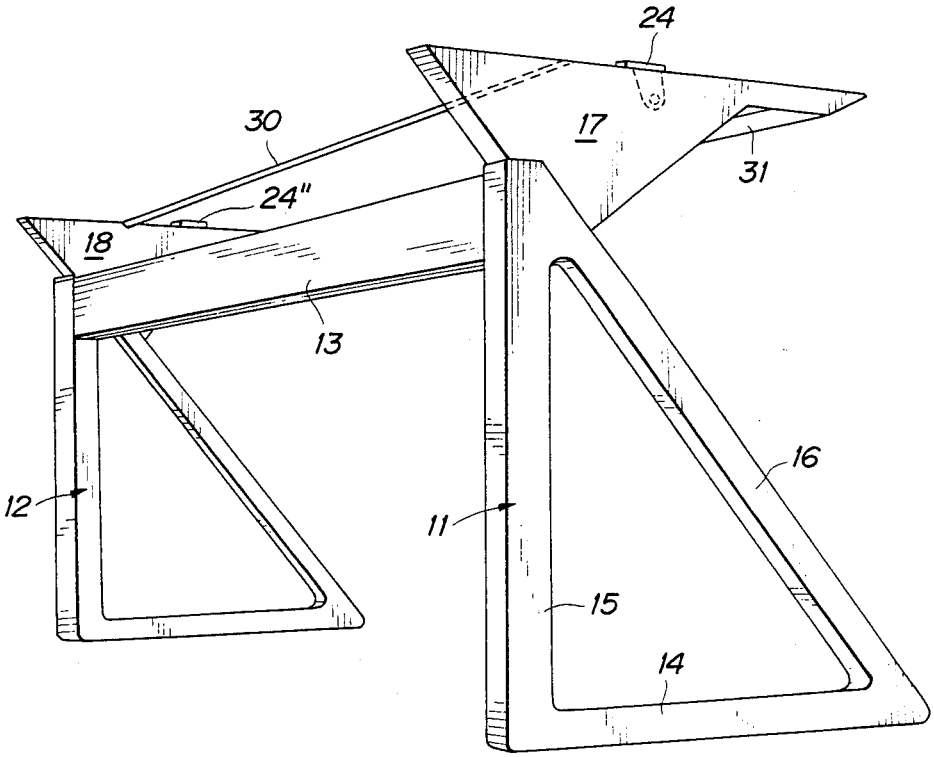
FIG. 5 is a perspective view of the desk frame from the rear.
Figure 6:
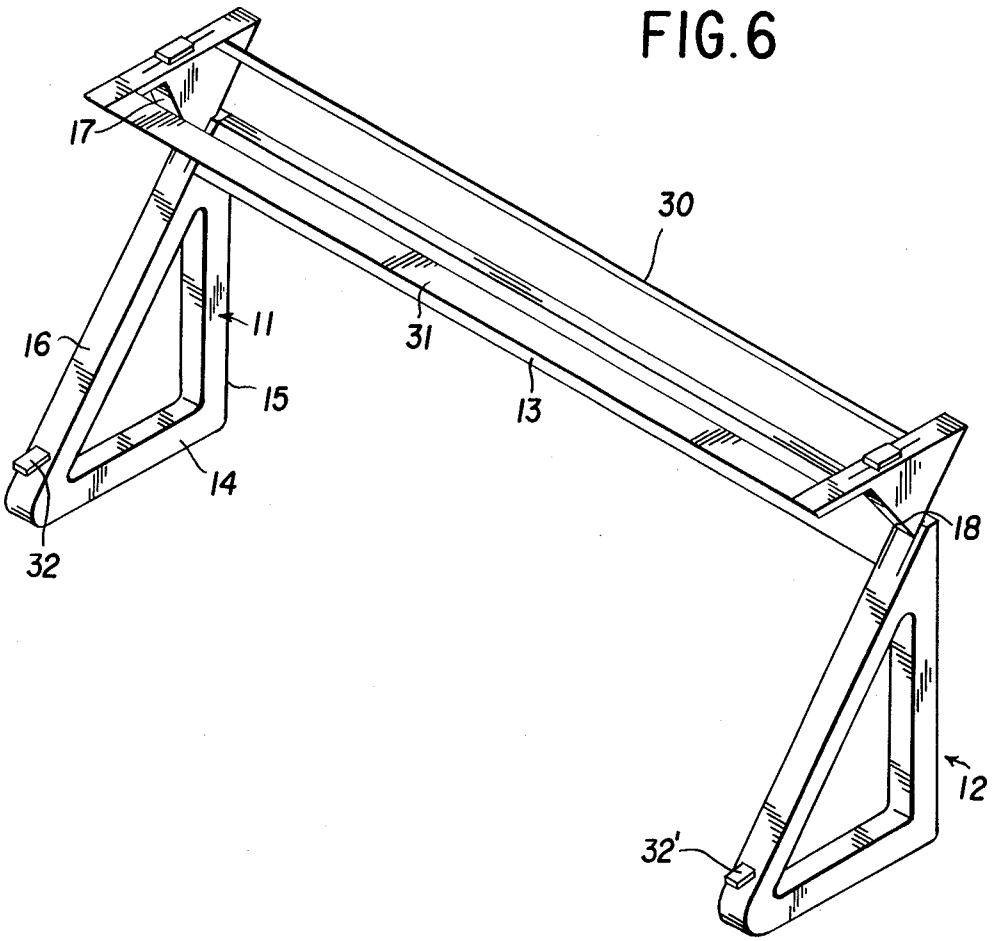
FIG. 6 is a perspective view of the desk frame from the front.

FIG. 1 shows a preferred embodiment of the invention, which preferably takes the form of a writing or drawing table. It possesses a desk frame 10 with two side parts 11 and 12, which are joined together by a horizontal connecting frame 13 (FIG. 5). The side parts 11 and 12 have the same form, as for example in the present case, the form of a right angled triangle, each being made up of a level element 14, an upright element 15 and an oblique element running from the front to the back upwardly at a predetermined angle, the latter element forming the hypotenuse of the triangle. The level element 14 serves in this respect, as illustrated, as the base of the desk and is placed directly on the ground or is supported by adjustable feet if desired. The upright element 15 may serve to accommodate wiring, as for example in a trunking arrangement in accordance with the German patent application No. P 35 09 989.5, and the element 16 running obliquely upwards is preferably in the form of a hollow beam to receive a height adjustment device, which will be described in detail later on. The side part 12 will not be described separately, since its structure in all essential respects is the same as that of the side part 11, and since the height adjustment devices of the two side parts operate together.

The side parts 11 and 12 may naturally be constructed differently, as for example to take the form of a trapezoid, or with the upright element 15, in place of an open triangle, in the form of a triangle closed by side walls, and so on. Such variations shall come within scope of the present invention.

Figure 2:
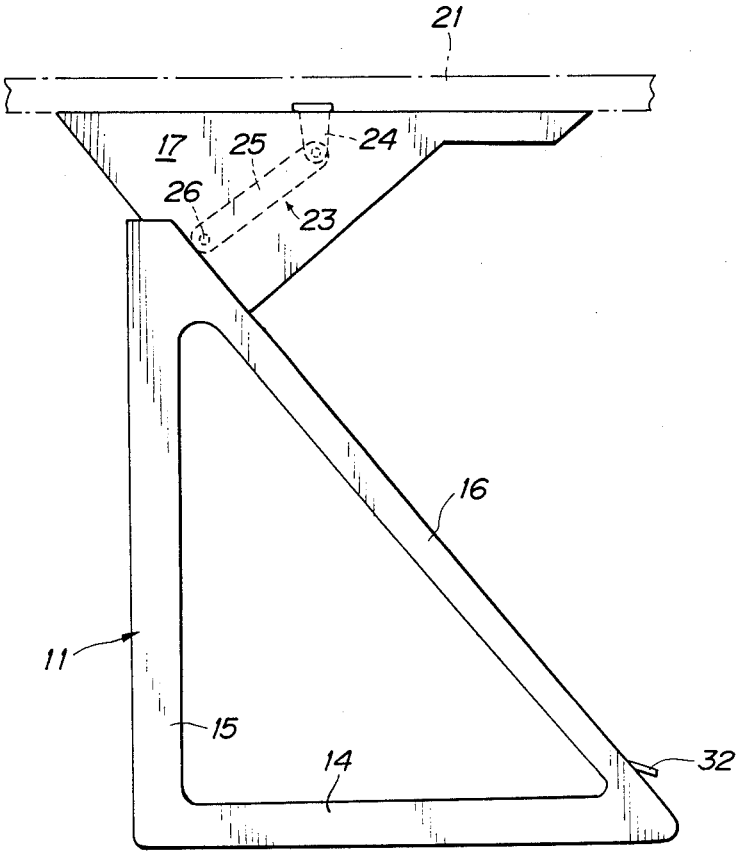
FIG. 2 is a side view on the same lines as FIG. 1 but with the top part of the desk at a high level.
Figure 4:
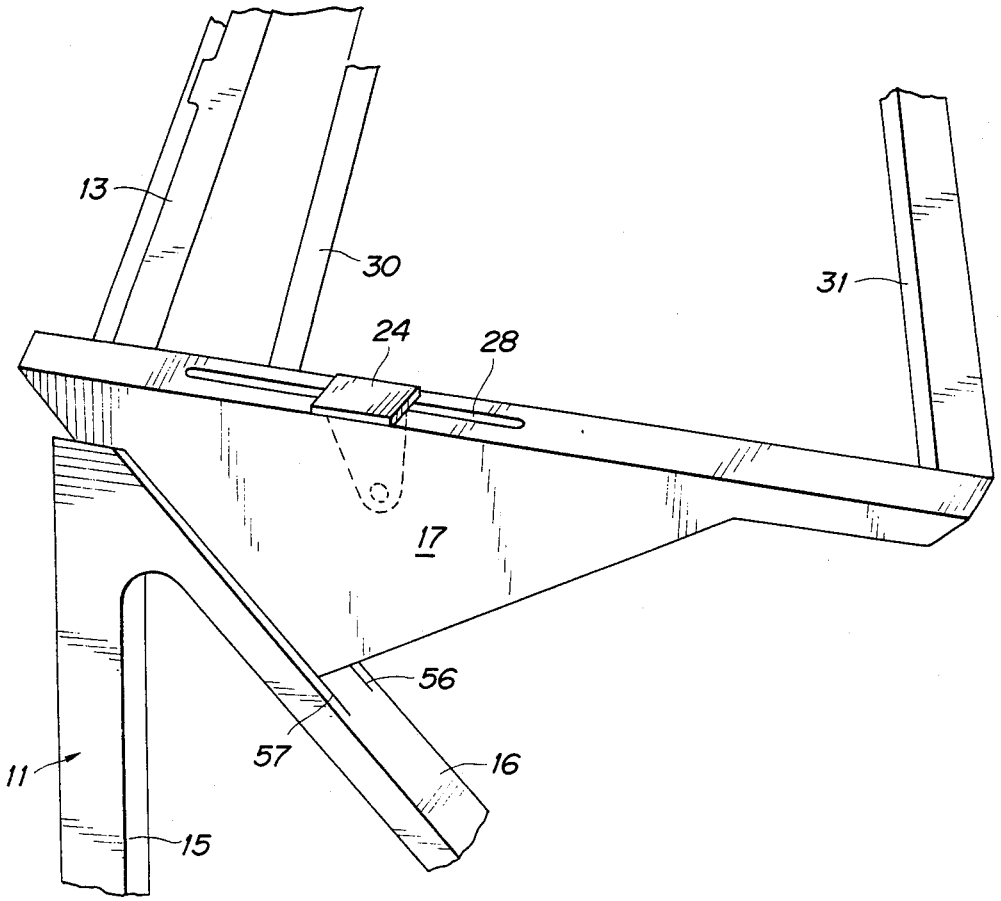
FIG. 4 is an elevation of a section of the desk frame without showing the top part.

At the top ends of the two sides parts 11 and 12 there are provided support members 17 and 18, respectively (seen FIG. 5) which may be set at different levels by the adjustment in height, as will be see from FIG. 1 (showing the lower setting) and FIG. 2 (showing the higher position). An upper part 21 of the desk is mounted on these support members 17 and 18 and has the form of a desk top, such desk top being able to be shifted in the direction of the arrows 22, shifting only taking place when the height is adjusted with using a height adjustment arrangement 23 to be described in what follows. The user of the desk is to be located on the right in FIGS. 1 and 2. The upper part 21 of the desk is respectively connected with the side parts 11 and 12 by an adjustment arrangement 23. FIGS. 1 and 2 indicate these adjustment arrangements, a downwardly projecting part 24 being fixed to the top part 21 of the desk and having its lower end articulating with a link 25, whose other end articulates at a pivot point 26 on the element 16 of the said part 11 (or the side part 12 in a similar manner). In this way on adjustment of the height of the support members 17 and 18, which at the same time causes a lateral displacement, the top part 21 of the desk will be held in its horizontal position in relation to the user, i.e. when the top part 21 of the desk is lifted or lowered, it is not, or only slightly, moved towards or away from the person sitting at the desk. As FIG. 4 shows, a part 24 is slidingly mounted in a slot 28 of the support member 17, i.e. when there is vertical adjustment there is a relative motion between the part 24 and the top side of the support member 17. As FIG. 5 shows, a part 24'', corresponding to the part 24 is provided on the support member 18. In the support member 18 there is a similar adjustment arrangement for controlling motion of this part 24", which in turn is also secured to the desk top.

The support members 17 and 18 are joined together by way of connecting elements 30 and 31. If required faces for the top desk part 21 to slide upon may be provided on the connecting elements, this not being illustrated. For operation of the vertical adjustment arrangement there are foot-operated knobs 32 and 32' on the oblique upwardly running element of the respective side parts 11 and 12. The operation of a foot knob 32 or 32' operates the height adjustment arrangements of both side parts 11 and 12 via a connecting shaft placed in the connection part 13 so that the two support members 17 and 18 are simultaneously set.

Figure 3:
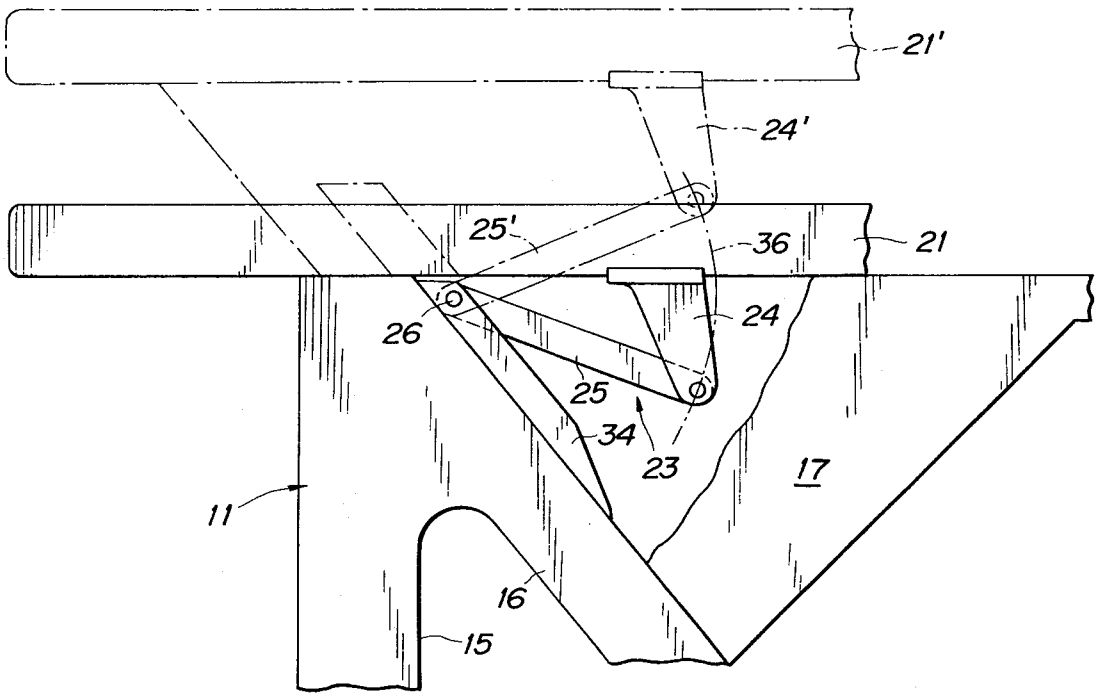
FIG. 3 is a diagrammatic view for explaining the operations involved in adjustment of height.

FIG. 3 shows the control of the motion of the top part 21 of the desk on a larger scale. The continuous lines indicates the lower position of the top part 21 of the desk while the chained lines indicate an upper position. In the upper position the reference numerals include prime signs. Two lugs 34 (see FIGS. 7 and 9) are provided on the oblique upwardly running element 16, such lugs having aligned holes 35 therethrough. A shaft 26 is arranged in these holes to serve as a pivot for the articulation with the link 25 so that the other end of the link 25 may turn along a circular path 36 about the shaft 25 as a center thereof. On adjustment in height of the support members 17 and 18 this lug will be moved through an angle of about 45° relative to the element 16, which is a level of about half of its vertical movement. Until this level top part 21 of the desk will firstly move somewhat to the front and thereafter somewhat to the rear, such motion to the front and the back being small and hardly noticed. It is obviously possible for the adjustment device 23 to be arranged to the left of the side part 11 in FIG. 3, the lug 34 then projecting to the left. It would also be possible to use other forms of linkage and mechanical connection to achieve the same effect, the illustrated form of the adjustment device however being particularly simple in design, one reason for this being that the link 25 is placed out of sight within the support member 17 or 18, respectively. This link 25 may however articulate with the connection part 13 as well and it might also be directly connected with the top part 21 of the desk; however an design is to be preferred in which the link 25 will be on about horizontal level when the top part is half way up, since in this case the horizontal motion of the top part 21 of the desk will be minimized.

As shown in FIG. 8 the oblique upwardly extending element 16 is in the form of a hollow beam and is separated by a rectangular partition 40 into a large cavity 41 with a rectangular cross section and a smaller cavity 42 also having a rectangular cross section. The smaller cavity 42 accommodates a driving rod 43, which is operated by the foot-operated knob 32 and may be axially shifted in this respect. The large cavity 41 serves to accommodate a rod 44 that has a u-like cross section and is to be seen in FIGS. 10 and 11. In the middle of this rod 44 there is an upper pair of rollers 45 and 45' (see FIG. 8) mounted on a pin 46 and at the lower end 50 of the rod 44 there is pair of rollers 47 mounted on a pin 48, for which purpose there are holes 49 (not shown) in the rod 44. At the lower end 50 of this rod 44 there is a piston spring 51 placed at the lower part of the element 16 so as to act on the end 50 of the rod 44 and urge it upwards (see FIG. 1). The rod 44 may naturally have a rectangular cross section or a square cross section in place of a channel one, the important consideration being the strength of the rod and on the other hand good guiding by the rollers 45 and 47. The rod 44 should have a minimum weight.

The pairs of rollers 45 and 47, whose support pins each run parallel to the upper part 21 of the desk, roll on the walls of the large cavity 41 and support the support member 17 (on the upper end of the rod 44) laterally owing to the large distance between them so that the support part may be shifted in height with only a little friction. FIG. 10 shows the connection between the support member 17 with the rod 44. The level part 53 of the support member 17 is, as illustrated, made broader than the rod 44 and the two spaced walls 54 and 55 of the this part 53 slide, on displacement in slots 56 and 57, respectively, (see FIG. 9) on the top side of the oblique upwardly extending element 16. The link 25 is placed inside the part 53 when assembled.

Figure 12:
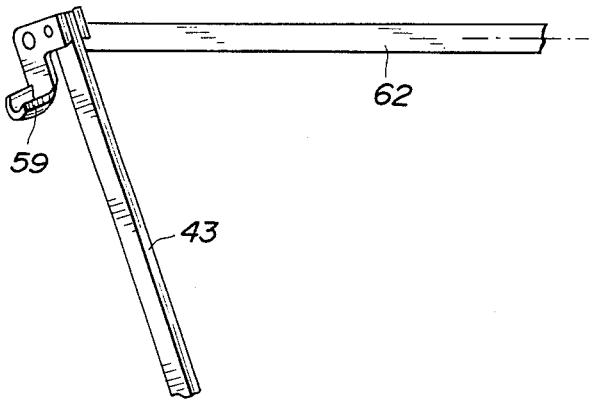
FIG. 12 is a perspective view of the linkage for operation of the lock for adjustment of height.

For adjustment of height the rod 44 is provided with locking or catch recesses 58 on the top at one side—although it would be possible to have such recesses in a separate element as well which would be connected with the rod 44. And on the element 16 a catch or detent 59 is pivoted, that may fit into such recesses 58 and so lock the rod 44 at the desired height. The catch 59 may be released by using the operating rod 43, when the foot knob 32 or 32' is depressed. It would be possible to also have a catch which would permit stepless adjustment. As FIG. 12 shows, the catch 59 is preferably connected by a corresponding catch in the side part 12 by a horizontal rod 62 placed in the connection part 13 so that the catches of both side parts are always simultaneously worked whichever of the foot knobs 32 and 32' are used.

After release of the catch 59 it is possible for the rod 44 to shift upwards or downwards on its rollers 45 and 47, motion in the upward direction being aided by the piston spring 51, that acts on the lower end 50 of the rod 44 and urges the same in an upward direction, see FIG. 1. Although during the course of such motion the desk top 21 is displaced in the direction of the arrows 22 (FIG. 1) when it is moved upwards or downwards, such horizontal motion is very small in amount, since it moves in relation to the support members 17 and 18, as has been described. The plan of the top part 21 of the desk will for this reason remains almost stationary during adjustment of height.

It is naturally possible for numerous modifications to be made within the scope of the present invention without abandoning the essential principles thereof.

I claim:

1. A height adjustable table comprising:

at least one side frame including a level element adapted to be placed on a floor and a hollow oblique element having an upper portion and connected to the level element to extend obliquely upwardly therefrom;

a horizontal table top;

at least one table top side support having an upper horizontal surface for supporting said horizontal table top thereon;

height adjusting means including a rod connected to said table top side support and located within said hollow oblique element and means for moving said rod within said hollow oblique element to move said side support and table top supported thereon to a desired height relative to said side frame;

means for securing said rod and thus said side support and table top at said desired height; and an adjusting device connecting said table top and said side frame for moving said table top laterally on the upper horizontal surface of said table top side support while said side support and table top are moved to said desired height with minimal lateral movement of said table top relative to the side frame.

2. A height adjustable table according to claim, 1 in which said adjusting device comprises at least one link having a first end pivotally connected to the oblique element and a second end pivotally connected to the table top to control said lateral movement of the table top.

3. A height adjustable table according to claim 2, in which said adjusting device further includes a projection attached to the table top to extend downwardly therefrom, said second end of the link being pivotally connected to the projection.

4. A height adjustable table according to claim 3, in which said adjusting device is covered by the table top side support so that the adjusting device is not seen from outside.

5. A height adjustable table according to claim 1, in which said height adjusting means further comprises a spring device connected between the rod and the side frame urging said rod upwardly to easily move the table top side support with the table top relative to the side frame when adjusting height of the table top, and said securing means comprises a locking device situated between the rod and the side frame to stop movement of the rod relative to the side frame.

6. A height adjustable table according to claim 5, in which said height adjusting means further includes at least two rollers rotationally connected to the rod, said rollers being spaced apart from each other within said hollow oblique member for sliding the rod along the inside of the oblique element.

7. A height adjustable table according to claim 6, in which said locking device comprises a plurality of notches formed on the rod, a detent situated adjacent and removably-engageable with the notches, and a driving rod connected to the detent whereby when the driving rod is actuated, the detent engaged with one of the notches disengages from the notch to thereby allow the side support and table top to move as desired.

8. A height adjustable table according to claim 7, further comprising a foot pedal connected to said driving rod for axially shifting said driving rod to engage and disengage said detent from said notches.

* * * * *